US011609054B2

(12) United States Patent
Alson

(10) Patent No.: US 11,609,054 B2
(45) Date of Patent: Mar. 21, 2023

(54) OFFSET PUSH BUTTON MAGAZINE RELEASE FOR A FIREARM

(71) Applicant: Align Tactical, LLC, Austin, TX (US)

(72) Inventor: Joel Alson, Austin, TX (US)

( * ) Notice: Subject to any disclaimer, the term of this patent is extended or adjusted under 35 U.S.C. 154(b) by 19 days.

(21) Appl. No.: 17/345,867

(22) Filed: Jun. 11, 2021

(65) Prior Publication Data

US 2021/0389067 A1 Dec. 16, 2021

Related U.S. Application Data

(63) Continuation-in-part of application No. 29/737,808, filed on Jun. 11, 2020.

(60) Provisional application No. 63/051,893, filed on Jul. 15, 2020.

(51) Int. Cl.
*F41A 9/59* (2006.01)
*F41A 3/66* (2006.01)

(52) U.S. Cl.
CPC . *F41A 9/59* (2013.01); *F41A 3/66* (2013.01)

(58) Field of Classification Search
CPC ..... F41A 9/59; F41A 35/00
See application file for complete search history.

(56) References Cited

U.S. PATENT DOCUMENTS

2012/0198742 A1* 8/2012 Troy ..... F41A 3/66 42/6
2016/0069628 A1* 3/2016 Fluhr ..... F41A 35/06 42/6

* cited by examiner

*Primary Examiner* — J. Woodrow Eldred
(74) *Attorney, Agent, or Firm* — Mason A. Gross; The Law Office of Mason A. Gross, PLLC

(57) ABSTRACT

An offset magazine release button includes a body portion and a generally stairstep-shaped end portion. The body portion may be inserted into a magazine release opening of a firearm. The stairstep-shaped end portion may include an indention portion providing or creating a floor or floor portion and a narrow stairstep riser. The floor, when part of the assembled firearm, is generally flush with the firearm's gripping surface to create an augmented gripping surface that may allow the operator to have a higher grip to help control recoil. The end portion also includes an offset contacting pad. The floor transitions to the riser, which then transitions to the pad. The pad has a generally perpendicular ledge or surface extending toward an actuating thumb position of the operator's grip. The pad surface may be textured to provide for better contact with the operator's thumb when depressing the button to release a magazine.

20 Claims, 10 Drawing Sheets

FIG. 14
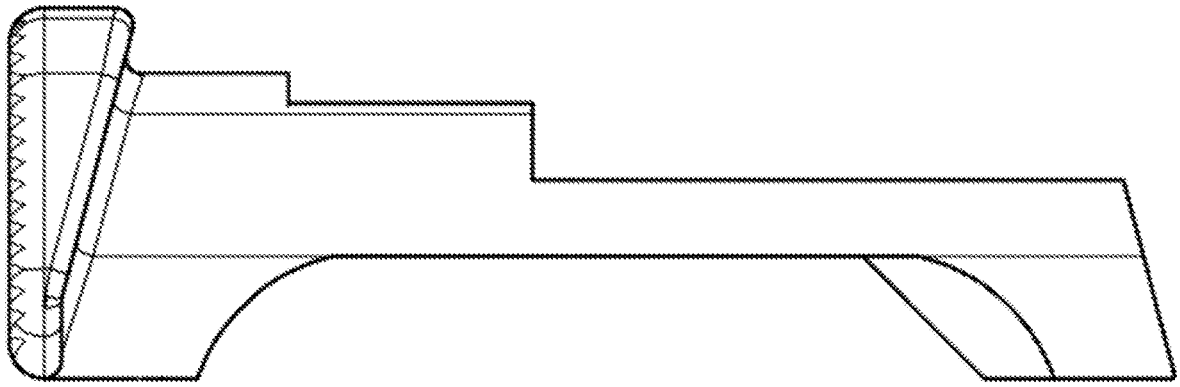
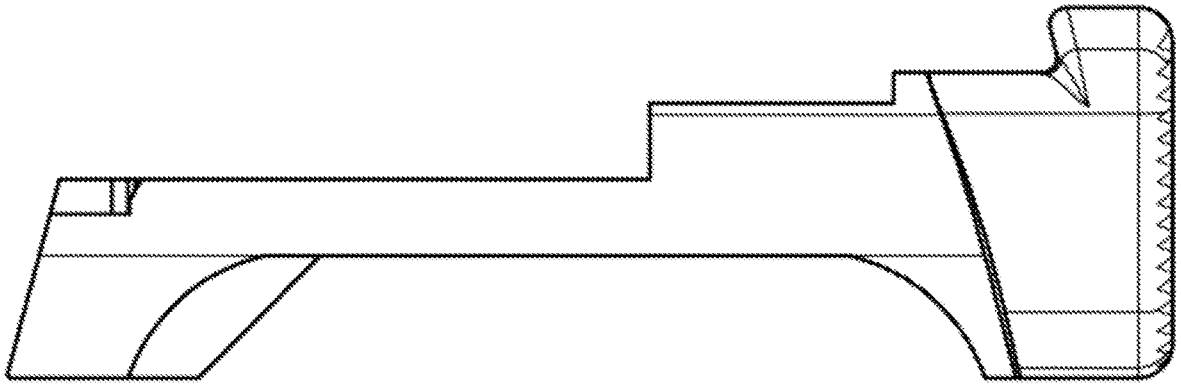
FIG. 15

OFFSET PUSH BUTTON MAGAZINE RELEASE FOR A FIREARM

CROSS-REFERENCE TO RELATED APPLICATIONS

The present application is a continuation-in-part of U.S. Design Patent Application Ser. No. 29/737,808, filed Jun. 11, 2020, and claims the benefit of U.S. Provisional Patent Application Ser. No. 63/051,893, filed Jul. 15, 2020.

FIELD OF THE INVENTION

The field of the invention generally relates to firearm components, and more particularly, to firearm magazine releases with improved ergonomics.

BACKGROUND OF THE INVENTION

Firearm magazine releases, also known as magazine catches, serve to retain magazines via an internal spring-loaded "catch" that is designed to "release" retention when actuated externally by an operator, through such acts as depressing a button on a firearm. Such release buttons typically are designed to be actuated by average-sized hands. As such, the general button shape/profile, or location of some magazine releases on firearms may unfortunately cause some operators' fingers to rub/chafe against it, causing sores or injury. Some magazine releases may also be out of reach of an operator's thumb, forcing the operator to shift the firearm in their hand to release a magazine, thereby slowing down reloading until a proper firing grip is re-established.

Magazine release buttons that extend from or near the grip of the firearm may offer ease-of actuation by making their protruding or contacting surface taller or wider. Although some of these designs may reduce the potential need to shift the firearm in-hand, they may not address existing ergonomic issues that some users may experience, such as the magazine release encroaching upon the same space their fingers naturally rest, which may induce chafing or sores.

Some prior magazine release or offset component designs include the following:

U.S. Pat. No. 6,141,895A, issued Nov. 7, 2000 to SIG ARMS INTERNATIONAL AG, entitled "MAGAZINE RELEASE CATCH FOR A PISTOL," which describes a traditional American-style thumb actuated magazine release for a pistol, which has a generally triangular shaped edge that extends into the potential gripping area.

U.S. Pat. No. 9,518,792B1, issued Dec. 13, 2016 to Battlearms Ip LLC, entitled "ENHANCED MAGAZINE RELEASE BUTTON ASSEMBLY," which describes an ergonomically shaped release button that contours to allow the pointer finger to mate comfortably with the contact surface of the release and has a removable pad.

U.S. Pat. No. 20,100,287,806A1, issued Nov. 18, 2010 to Microtech Small Arms Res, entitled "MAGAZINE RELEASE FOR USE WITH PISTOL," which describes an ambidextrous magazine release that is positioned along the trigger guard of a pistol, relocating the traditional American-style thumb release away from the gripping surface.

U.S. Pat. No. 9,829,262B1, issued Nov. 28, 2017 to Vista Outdoor Operations LLC, entitled "OFFSET FIREARM SELECTOR SWITCH," which describes a rifle safety lever that angles an otherwise straight safety switch.

SUMMARY OF THE INVENTION

A magazine release button is disclosed herein, providing advantages that may avoid some of the issues describe above related to otherwise fixed and obstructing finger contacting surfaces of prior magazine release buttons, in accordance with embodiments of the present disclosure. These embodiments may be constructed by removing (or not manufacturing) button material where an operator's gripping finger would naturally rest flush across an unobstructed grip, while also advantageously adding (or manufacturing) material to offset the position of the magazine release's thumb-engageable surface to a more usable and comfortable location for the operator.

As disclosed herein, a magazine release button having a shaft or body portion continuous with (or integrated with or otherwise attached to) a generally "stairstep"-shaped offset front end portion may address some of the issues described above, in accordance with embodiments of this disclosure. During assembly of the firearm, the shaft or body portion is inserted (or mostly inserted) into a magazine release opening or channel of the firearm. These stairstep shaped embodiments may include an indention portion (which may be a cutaway), providing for or creating a "floor" or "floor portion" that is generally flush with a firearm's grip (such as a pistol's grip) to create an augmented gripping surface for the operator's hand, the floor transitioning to a remaining narrower protruding offset "riser," "step riser," "extension," or "in-between" portion of the release button's shaft, and then transitioning to an expanded top button surface pad having a generally perpendicular "ledge" or surface that is directed toward the actuating thumb for operator engagement. It should be understood that the riser may have a flat or a non-flat surface that transitions between the floor and the thumb pad. The aforementioned structures or components form the stairstep shape. The top button surface may be textured with ridges, serrations, stippling, or the like that provide for better grip or contact for the operator's thumb when pushing the button to release a magazine.

One benefit of this configuration is that it permits or allows the operator to obtain a higher grip on the firearm by allowing the operator's primary gripping hand's middle finger to lay across the offset magazine release button's floor, which would have otherwise been the location of a protruding button shaft wall that possibly would cause chafing. A higher grip, in turn, enables greater recoil control by allowing the operator's hand(s) to be positioned closer to the bore axis of the firearm, reducing the leverage needed to resist the yawing torque generated from a reciprocating slide mass on a semiautomatic firearm and/or from the expelled propellant gas from ammunition detonation some distance away from the pivot point of an otherwise stationary grip. Controlling recoil allows the operator or shooter to get their sights back on target for quicker follow-up shots. Increased ergonomics may be another benefit, which may eliminate sores and chafing. A further benefit may be that the offset relocation positions itself higher up the frame of the firearm, such that there would be less distance for the operator's actuating thumb to travel to release the magazine. This may decrease or eliminate the need for smaller-handed shooters to have to "break" or adjust their grip to reach the button for releasing the magazine and may reduce reloading time by fractions of a second.

Other systems, methods, features, and advantages of the present disclosure will be or become apparent to one of ordinary skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Aspects of this disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which:

FIG. 14 is a right-side elevational view of the offset magazine release shown in FIG. 1;

FIG. 15 is a left-side side elevational view of the offset magazine release shown in FIG. 1;

DETAILED DESCRIPTION

The present application is a continuation-in-part of U.S. Design Patent Application Ser. No. 29/737,808, filed Jun. 11, 2020, and claims the benefit of U.S. Provisional Patent Application Ser. No. 63/051,893, filed Jul. 15, 2020, both of which are incorporated by reference herein in their entireties for all purposes. U.S. Pat. No. 6,141,895, issued Nov. 7, 2000, also is incorporated by reference herein in its entirety for all purposes.

Figures 1, 1A:
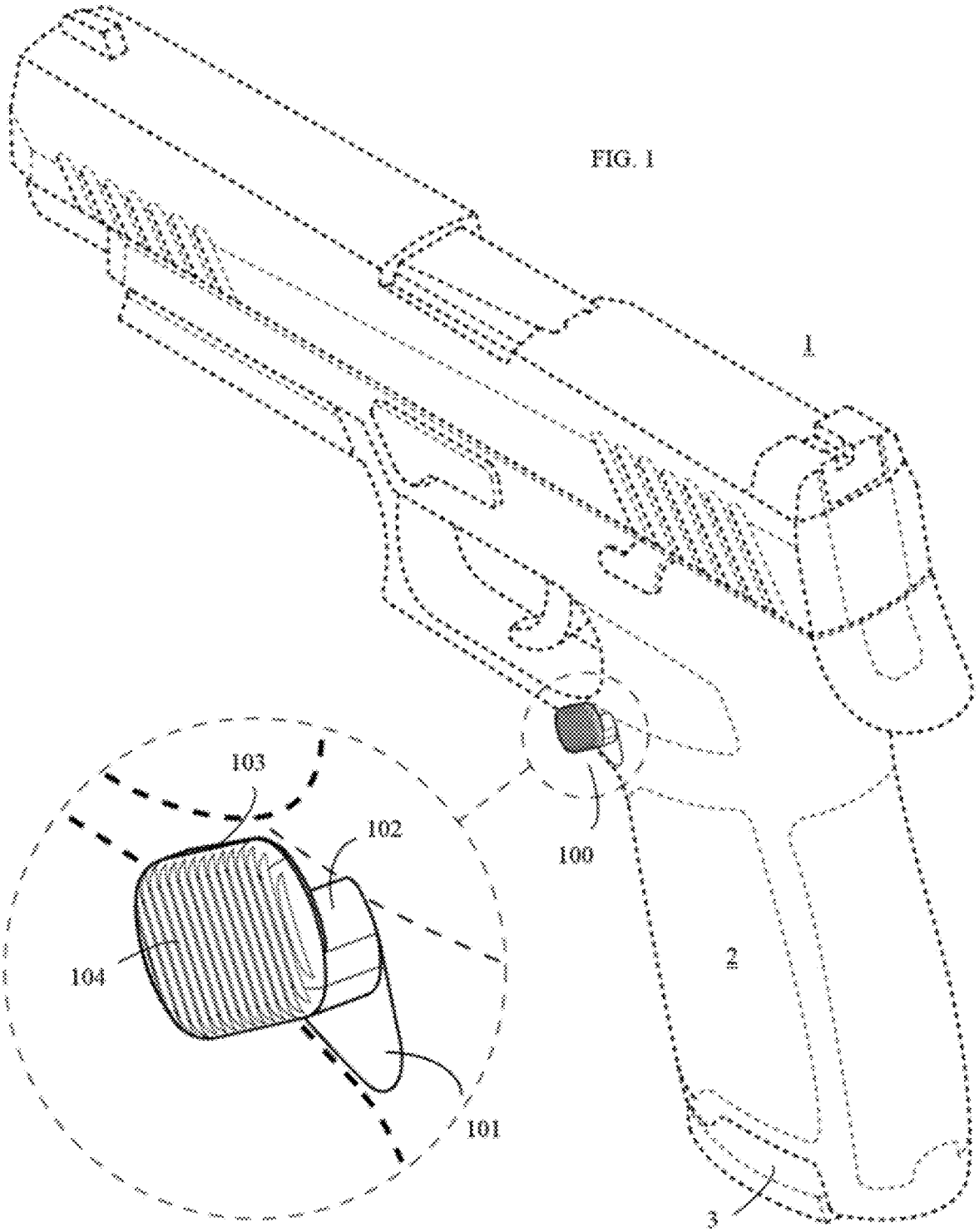
FIG. 1 is a rear, top, right-side perspective view of a portion of a magazine release in a firearm environment, in accordance with an embodiment of this disclosure.
FIG. 1A is a magnified view, of the portion of the offset magazine release shown in FIG. 1.
Figure 1B:
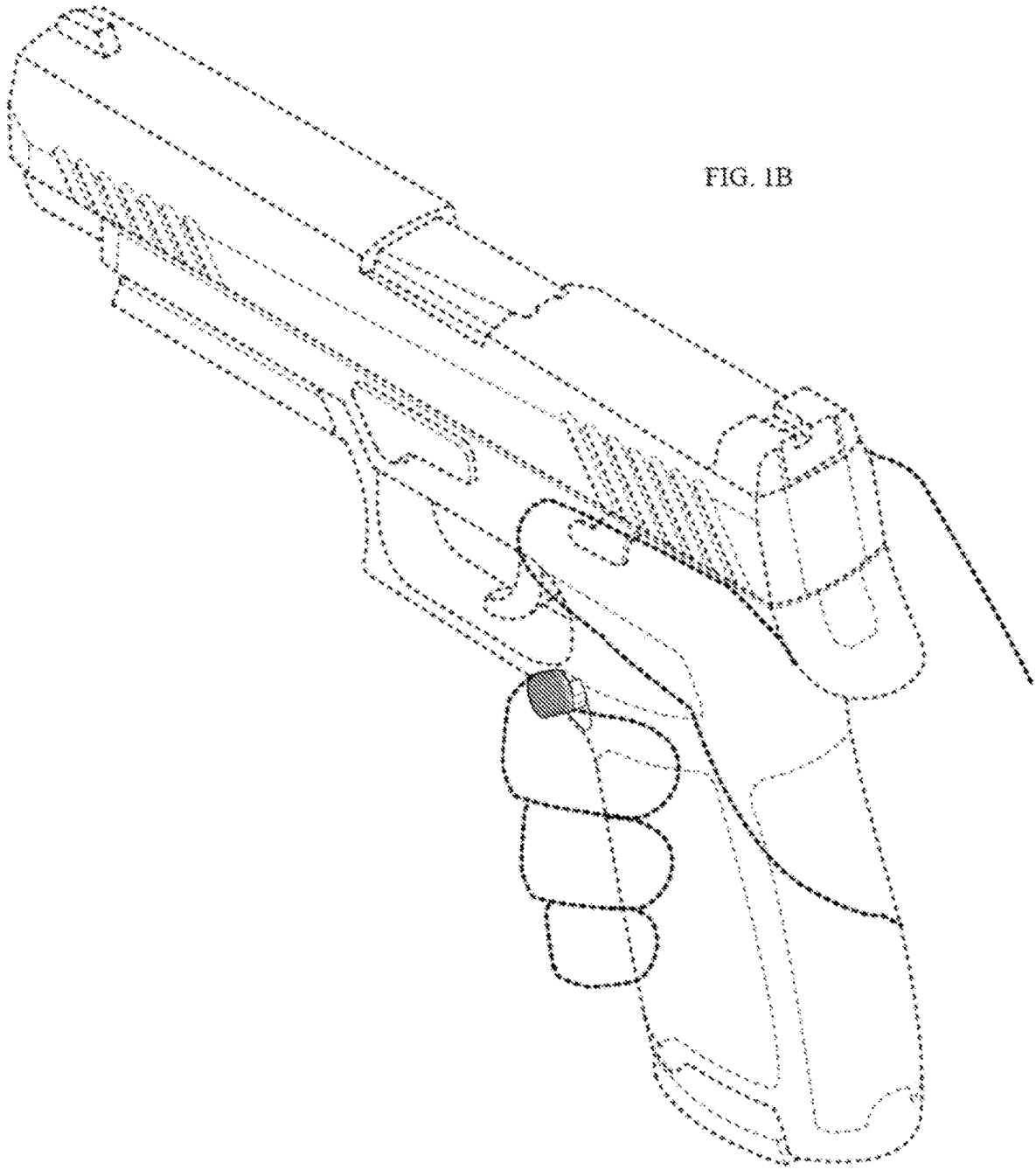
FIG. 1B is a view of the offset magazine release shown in FIG. 1, being gripped by an operator's hand.

FIG. 1 shows a rendition of a firearm 1 with a grip 2 and a magazine 3, and a portion of one possible embodiment of an offset magazine release 100, which is visually depicted in its orientation as installed in the firearm 1 (e.g., a pistol, a rifle, or the like). The offset magazine release 100 includes, as shown in the magnified view of FIG. 1A, a lower floor or floor portion 101 that is generally flush with the surrounding firearm 1 surfaces, when installed in the firearm, and which also appears and/or acts as an extension of the grip 2. The floor 101 allows the middle finger of the operator's primary gripping hand to lay across it, as shown in FIG. 1B, such that rubbing or chafing sores may not occur to this finger. A rise or extension or extension portion 102 (FIG. 1A) shaft or portion may also be included that protrudes outward from the firearm and is located on the upper-most portion of the offset magazine release 100 (i.e., furthest from the gripping hand), such that its bottom-facing wall (towards the ground) runs generally parallel with the middle finger when gripped. A button pad 103 may also be included on the upper end of the offset magazine release 100 that radiates transversely and is generally perpendicular to the extension 102, as to form a ledge or the like, which may increase or extend the finger-interfacing surface area closer towards where the thumb of the operator would be located when the firearm 1 is gripped. The button pad 103 may generally include traction surfacing or texturing in the form of serrations 104, stippling, ridges, or the like. The offset magazine release 100 also includes a body portion 105 (see FIG. 2). The offset magazine release 100, when assembled as part of the firearm 1, is set or sits within a complementary receiving opening or channel in the firearm 1 for engaging internal mechanisms that release the magazine when the button 103 is depressed by an operator. The extension 102 should extend far enough out from this opening in the firearm 1 such that when the operator pushes or depresses the button pad 103 with his or her thumb to physically release a magazine, no impedance occurs (or impedance is avoided) that would prevent the magazine from releasing. In other embodiments, this opening may be sized sufficiently to accommodate accepting all, most, or some of the button pad 103 when it is depressed while preventing or avoiding such impedance.

Figure 2:
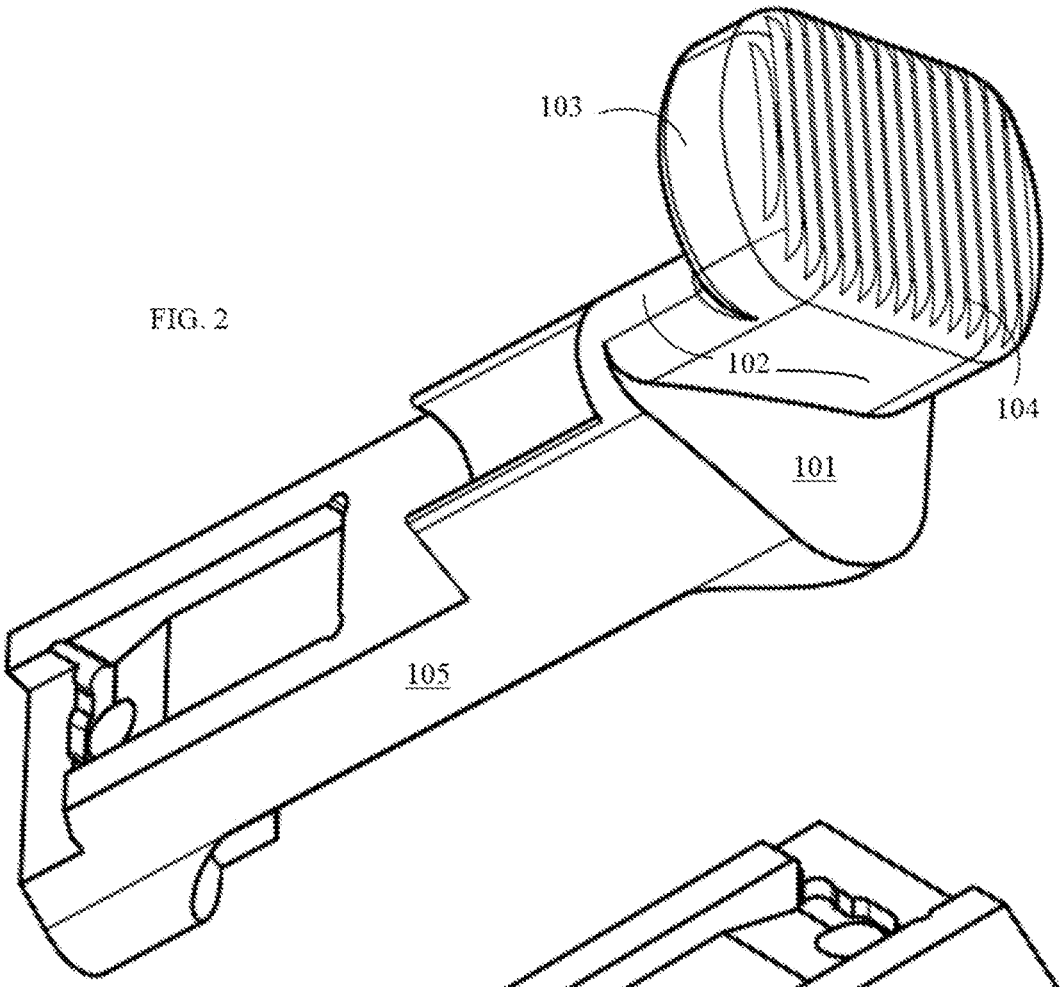
FIG. 2 is a top, front, left-side perspective view of the offset magazine release shown in FIG. 1.
Figure 3:
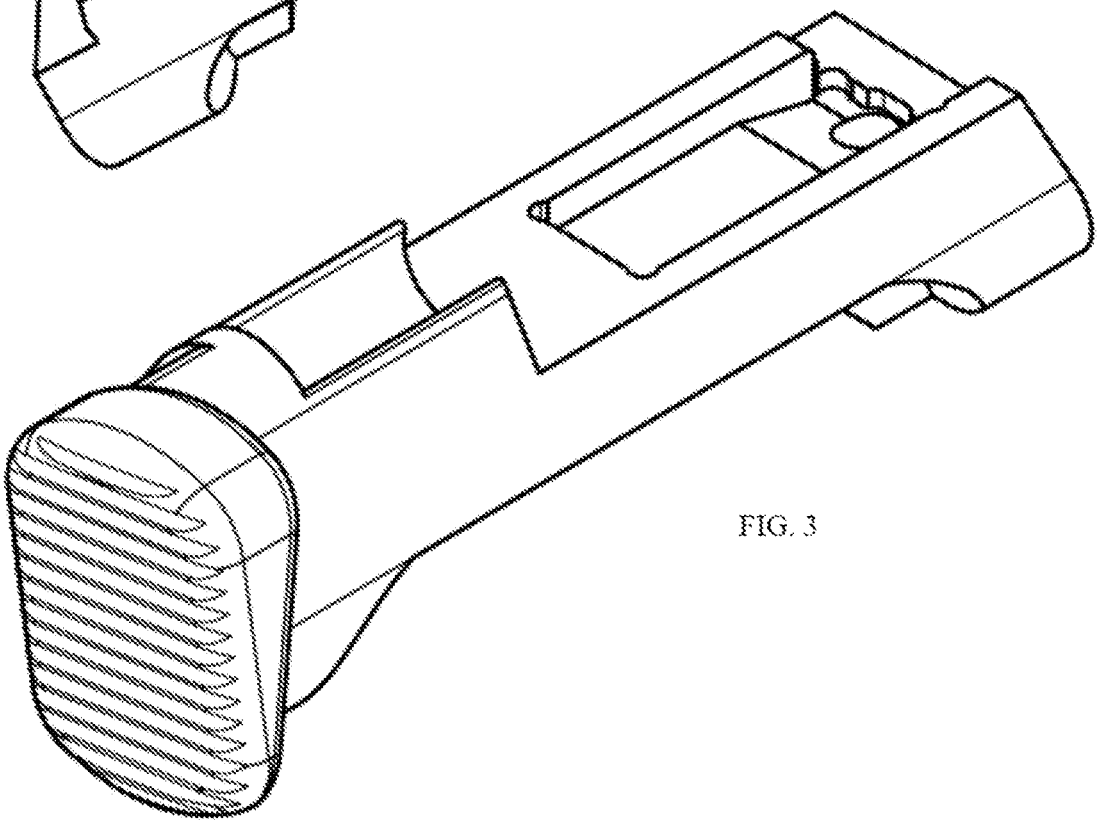
FIG. 3 is a top, front, right-side perspective view of the offset magazine release shown in FIG. 1.
Figure 4:
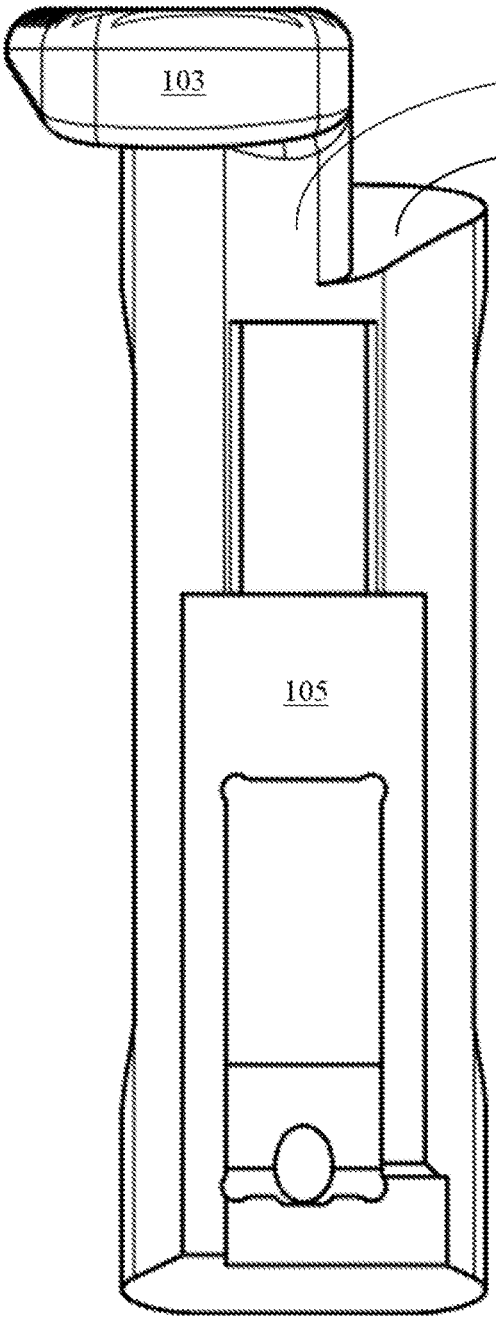
FIG. 4 is a top plan view of the offset magazine release shown in FIG. 1.
Figure 5:
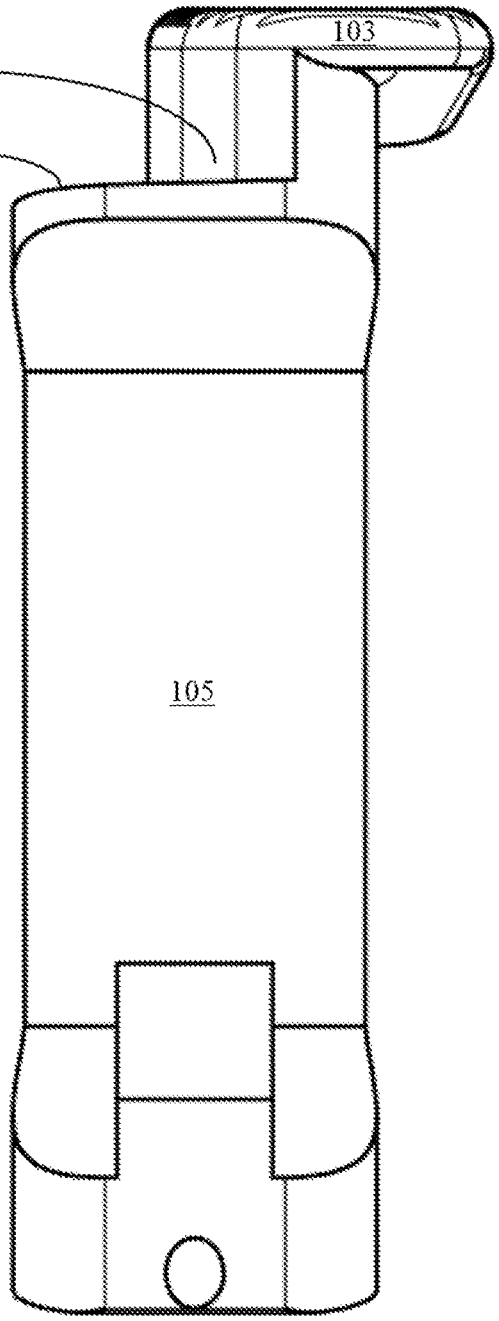
FIG. 5 is a bottom plan view of the offset magazine release shown in FIG. 1.
Figure 6:
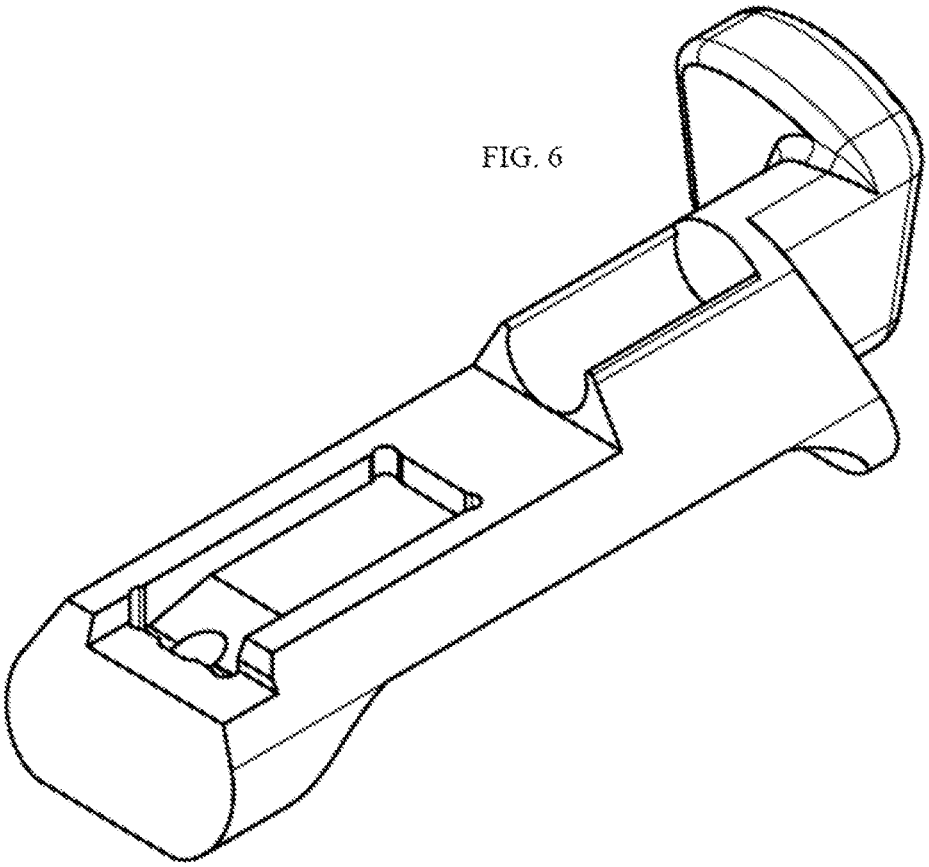
FIG. 6 is a top, rear, left-side perspective view of the offset magazine release shown in FIG. 1.
Figure 7:
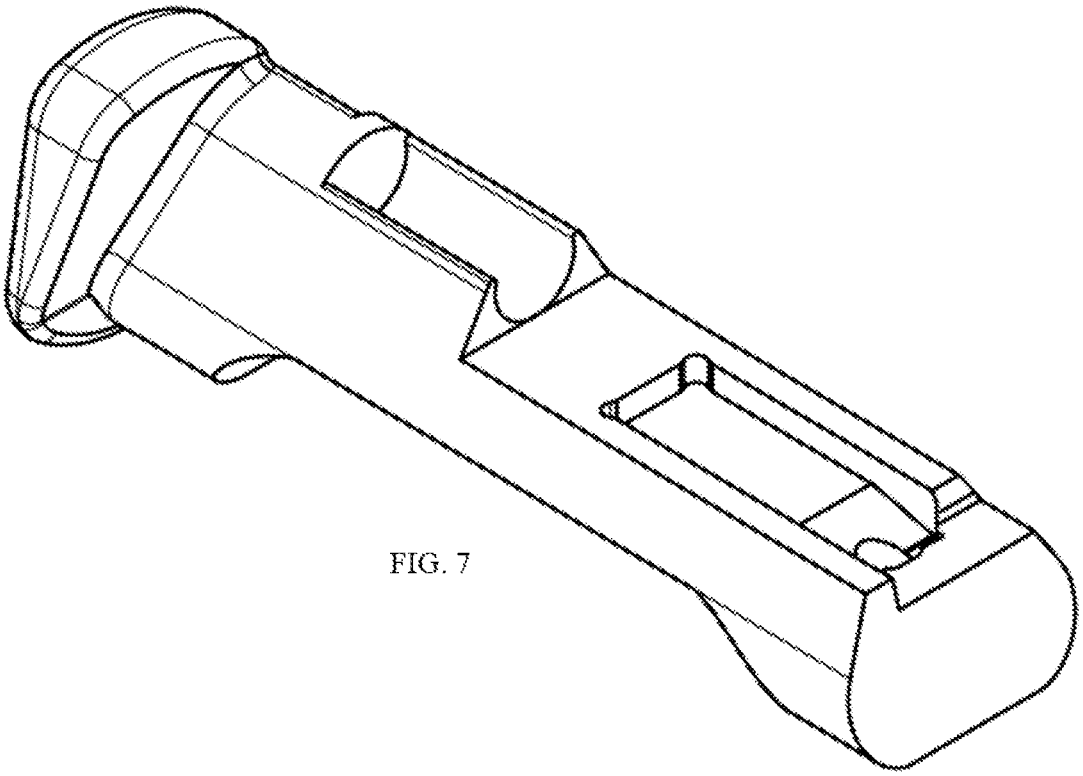
FIG. 7 is a top, rear, right-side perspective view of the offset magazine release shown in FIG. 1.
Figure 8:
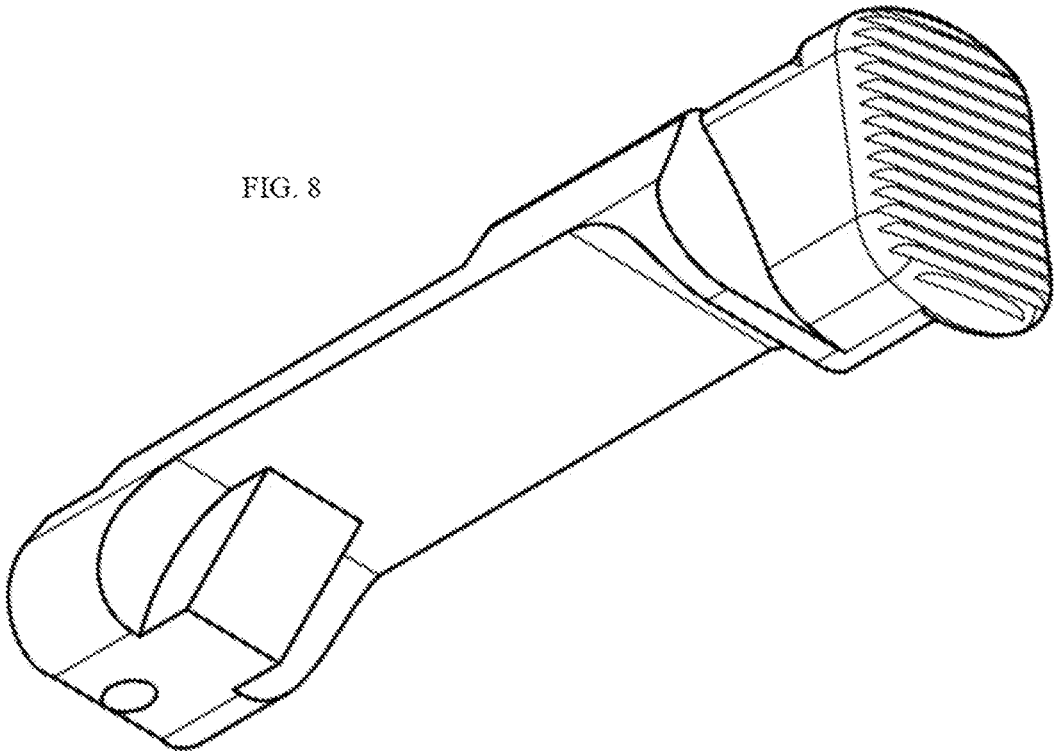
FIG. 8 is a bottom, front, left-side perspective view of the offset magazine release shown in FIG. 1.
Figure 9:
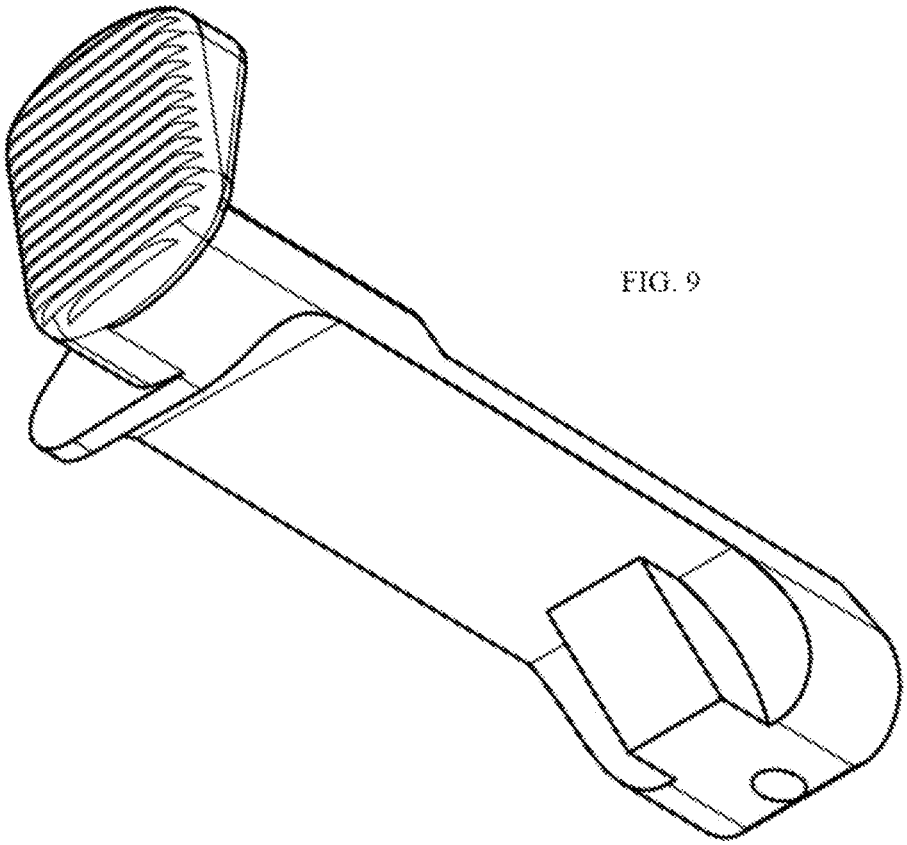
FIG. 9 is a bottom, front, right-side perspective view of the offset magazine release shown in FIG. 1.
Figure 10:
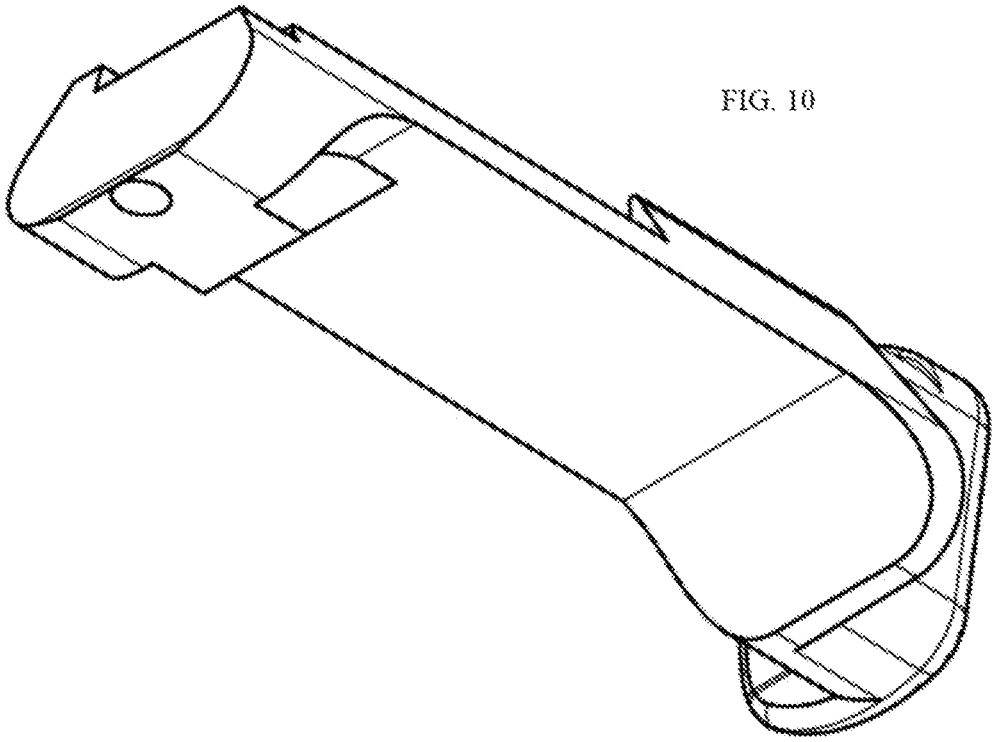
FIG. 10 is a bottom, rear, left-side perspective view of the offset magazine release shown in FIG. 1.
Figure 11:
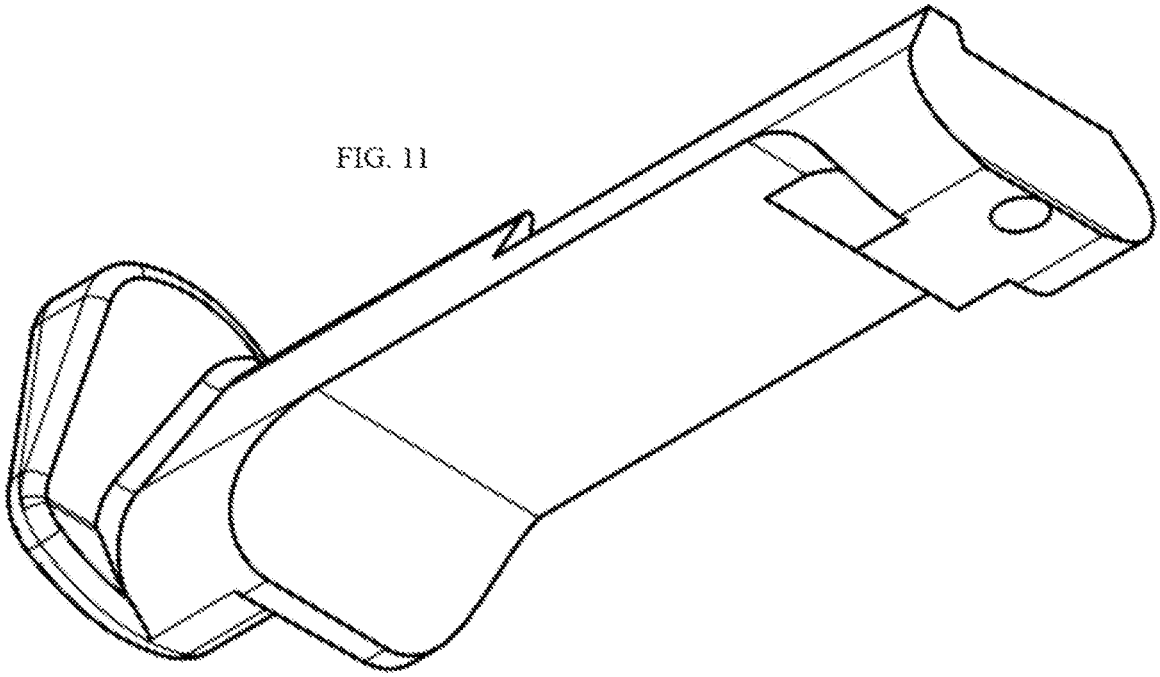
FIG. 11 is a bottom, rear, right-side perspective view of the offset magazine release shown in FIG. 1.
Figure 12:
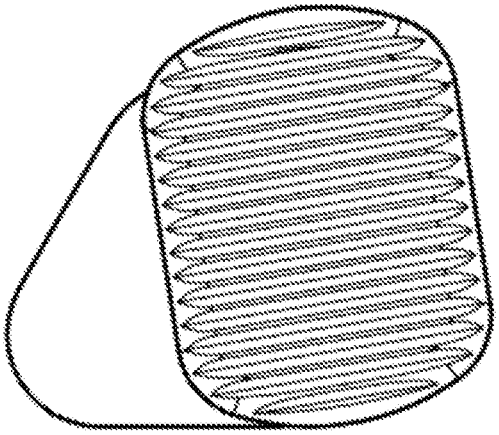
FIG. 12 is a front elevational view of the offset magazine release shown in FIG. 1.
Figure 13:
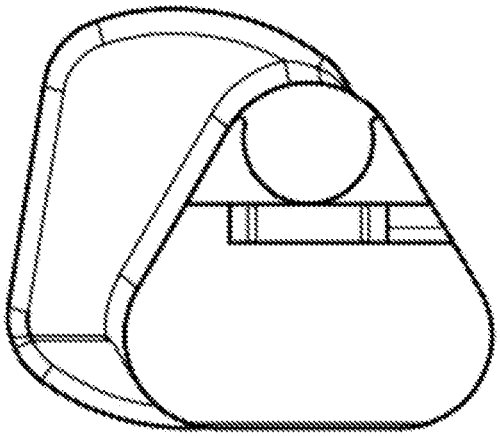
FIG. 13 is a rear elevational view of the offset magazine release shown in FIG. 1.
Figure 16:
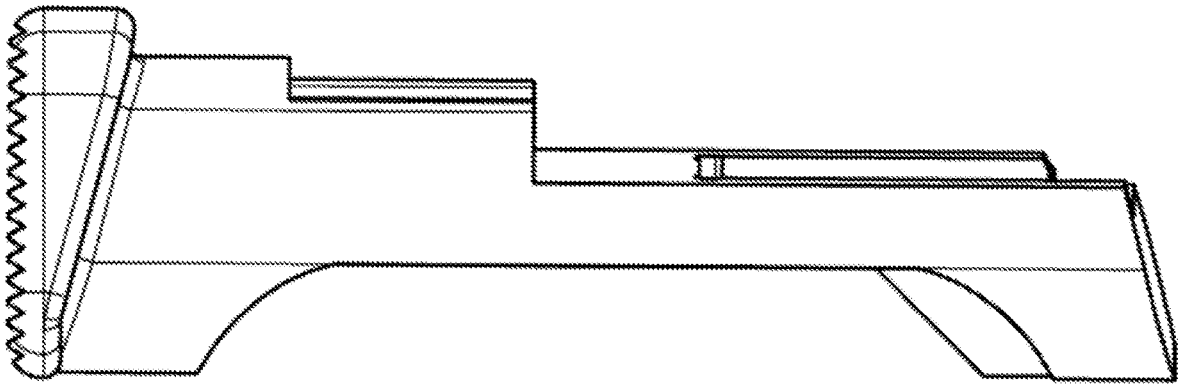
FIG. 16 is a right-side, top perspective view of the offset magazine release shown in FIG. 1.

FIG. 2 shows the body portion 105 of an embodiment of the offset magazine release 100, which provides retaining features to a lower firearm frame or the grip 2 on one side and retaining features to the magazine 3 on the other, as it typically runs into and completely through the firearm 1 to its other side when inserted into the complementary receiving opening discussed above in the firearm 1. The body portion 105 engages internal mechanisms to release the magazine when the button 103 is pressed, as would be understood by one of ordinary skill in the art having the benefit of this disclosure.

The structures described above together may create a generally stair-shaped or stairstep-shaped member that may serve ergonomic purposes by reducing/eliminating chafing while also relocating the operator engageable surfaces to be closer to the thumb for reducing reach and the need to shift the firearm in-hand for acquiring proper leverage when pressing the button 103 to release a magazine. These enhancements also allow the operator to obtain a higher grip on the firearm. And considering that the gripping hand(s) generally acts as a fulcrum point for rotational yaw due to the recoiling torque and muzzle rise from a reciprocating slide mass and muzzle blast upon firing the firearm (which gets magnified further away from the hand), these enhancements may also assist in minimizing the firearm's lifting muzzle flip during recoil.

The offset magazine release may be made from a polymer or metal material, such as steel with a form of corrosion protection inherent to the material or applied externally as a surface treatment or coating during manufacture. The offset magazine release may be made through traditional manufacturing methods, such as injection molding, ultraviolet (or other light) curing of polymers, thermal curing of polymers, milling/machining (CNC) bar stock, Metal Injection Molding (MIM), casting, forging, 3D printing, Additive Manufacturing (AM), or the like, or any other manufacturing method or combination of methods, to make similar components, as would be understood by one of ordinary skill in the art having the benefit of this disclosure. The installation, retention, and internal design features of the disclosed magazine release may be dictated by the original equipment manufacturer, as would be understood by one of ordinary skill in the art of firearm magazine releases having the benefit of this disclosure.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. An offset end portion of a firearm magazine release button, the firearm magazine release button having a body portion continuous with the offset end portion, the offset end portion comprising:

a floor portion;

an offset contacting pad having a contacting surface; and a step riser; and wherein the floor portion transitions to the step riser, which in turn transitions to the offset contacting pad, wherein the offset contacting pad is generally perpendicular to the step riser, and wherein the floor portion is configured to extend a grip of a firearm.

2. The offset end portion of claim 1, wherein the floor portion is configured to be generally flush with a surface of a firearm.

3. The offset end portion of claim 1, wherein the offset contacting pad and the step riser are configured to permit an operator of a firearm to obtain a higher grip on the firearm.

4. The offset end portion of claim 1, wherein the offset contacting pad and the step riser are configured to permit an operator of a firearm to have greater recoil control of the firearm.

5. The offset end portion of claim 1, wherein the offset contacting pad comprises texturing.

6. The offset end portion of claim 1, wherein the offset contacting pad is configured to extend toward a thumb position when an operator grips the firearm.

7. The offset end portion of claim 1, wherein the step riser is configured to extend sufficiently to avoid impeding release of a magazine from a firearm.

8. The offset end portion of claim 1, wherein an indention portion provides for the floor.

9. A magazine release button, a portion of which is for insertion in a magazine release button channel of a firearm, comprising:

a floor portion, wherein the floor portion is configured to act as a grip extension of the firearm; and a release extension portion configured to extend from an external surface of a firearm, the release extension portion configured to transition to an enlarged offset member having a transverse surface that extends outside a profile of the magazine release button channel.

10. The magazine release button of claim 9, wherein the floor portion is configured to be generally flush with a surface of the firearm.

11. The magazine release button of claim 9, wherein the floor portion and the release extension portion are configured to provide a higher grip for an operator of the firearm.

12. The magazine release button of claim 9, wherein the floor portion and the release extension portion are configured to allow greater recoil control of the firearm.

13. The magazine release button of claim 9, wherein the transverse surface comprises texturing.

14. The magazine release button of claim 9, wherein the enlarged offset member is configured to extend toward a thumb position when an operator grips the firearm.

15. The magazine release button of claim 9, wherein the release extension portion is configured to extend sufficiently to avoid impeding release of a magazine from the firearm.

16. A method of making an offset end portion of a firearm magazine release button, the firearm magazine release button having a body portion continuous with the offset end portion, comprising:

creating a floor portion and a step riser by forming an indention portion;

configuring the floor portion to act as a gripping extension of a surface of a firearm; and creating an offset contacting pad having a contacting surface extending toward a thumb position of an operator of the firearm.

17. The method of claim 16, further comprising texturing the contacting surface.

18. The method of claim 16, further comprising creating the step riser that extends sufficiently from the firearm to avoid impeding release of a magazine from the firearm upon depressing the offset contacting pad.

19. The offset end portion of claim 1, wherein the floor portion comprises an augmented gripping surface.

20. The magazine release button of claim 9, wherein the floor portion comprises an augmented gripping surface.

* * * * *